US007025539B2

(12) United States Patent
Irvine

(10) Patent No.: US 7,025,539 B2
(45) Date of Patent: Apr. 11, 2006

(54) SHEET PILE FOR FORMING BARRIER WALLS

(75) Inventor: John E. Irvine, Atlanta, GA (US)

(73) Assignee: CMI Limited Company, Columbus, OH (US)

( * ) Notice: Subject to any disclaimer, the term of this patent is extended or adjusted under 35 U.S.C. 154(b) by 0 days.

(21) Appl. No.: 10/645,086

(22) Filed: Aug. 21, 2003

(65) Prior Publication Data

US 2005/0042038 A1 Feb. 24, 2005

(51) Int. Cl.
*E02D 5/02* (2006.01)
*E02D 5/08* (2006.01)
*E02D 5/16* (2006.01)

(52) U.S. Cl. ..... 405/274; 405/272; 405/278

(58) Field of Classification Search ..... 405/262, 405/281, 284, 272–278, 31
See application file for complete search history.

(56) References Cited

U.S. PATENT DOCUMENTS

| | | | | |
|---|---|---|---|---|
| 3,825,465 | A | 7/1974 | Stock | 161/112 |
| 4,355,448 | A | 10/1982 | Ezaki | 29/413 |
| 4,917,543 | A * | 4/1990 | Cole et al. | 405/262 |
| 5,161,917 | A * | 11/1992 | Papetti | 405/284 |
| 5,333,971 | A | 8/1994 | Lewis | 405/281 |
| 5,364,682 | A | 11/1994 | Tanaka et al. | 428/138 |
| 5,511,355 | A | 4/1996 | Dingler | 52/729.5 |
| 5,865,005 | A * | 2/1999 | Cataldo | 52/598 |
| 6,000,883 | A | 12/1999 | Irvine et al. | 405/281 |
| 6,357,969 | B1 * | 3/2002 | Wheeler et al. | 405/274 |
| 6,575,667 | B1 | 6/2003 | Burt et al. | 405/287 |
| 6,675,547 | B1 * | 1/2004 | Golcheh | 52/741.13 |
| 6,715,964 | B1 | 4/2004 | Nottingham | 405/278 |
| 2002/0054791 | A1 * | 5/2002 | Nottingham | 405/285 |
| 2002/0112428 | A1 | 8/2002 | Dingler | 52/309.16 |
| 2003/0003828 | A1 | 1/2003 | Ellison et al. | 442/268 |
| 2004/0065034 | A1 | 4/2004 | Messenger et al. | 52/309.11 |

FOREIGN PATENT DOCUMENTS

| | | | |
|---|---|---|---|
| JP | 57155437 A | * | 9/1982 |
| JP | 63312413 A | * | 12/1988 |
| JP | 01052913 A | * | 3/1989 |
| JP | 03156032 A | * | 7/1991 |
| JP | 09095937 | * | 4/1997 |
| JP | 2000001870 | * | 1/2000 |

* cited by examiner

*Primary Examiner*—Jong-Suk (James) Lee
(74) *Attorney, Agent, or Firm*—Thomas, Kayden, Horstemeyer & Risley LLP

(57) ABSTRACT

A series of duplicate structural panels form a substantially flat sea wall, barrier wall, and the like, fabricated of synthetic resin material for driving into soils. The structural panel is elongated and of constant size and shape along its length, and is characterized by having been extruded lengthwise. The structural panel includes, in cross section, a central wall section having an inner surface, an outer surface, and opposed side wall sections. A male locking element is disposed on and extends laterally from one side section and a female locking element is disposed on and extends laterally from the other side wall section, the female locking element being configured to slidably receive and retain the male locking element. First and a second strengthening flanges are integrally formed on the inner surface, both substantially perpendicular to the central wall section and substantially parallel to each other. The first and second strengthening flanges extend along the length of the structural panel.

29 Claims, 4 Drawing Sheets

SHEET PILE FOR FORMING BARRIER WALLS

FIELD OF THE INVENTION

The present invention relates generally to extruded structural panels fabricated of synthetic materials that are useful as pilings for driving into the earth and for forming sea walls, piers, dikes, barrier walls, retaining walls and the like. More specifically, the present invention relates to a structural panel constructed so as to minimize deterioration of the structural panel due to exposure to the elements and allow construction of a barrier wall having an exposed outer surface that is substantially free of protrusions and/or obstructions.

BACKGROUND OF THE INVENTION

Barrier walls that are formed from a plurality of elongated, vertically oriented piles typically are driven into the earth to a depth sufficient to support the panels in an upright attitude. In some cases, the piles are in the form of extruded structural panels and are formed with male and female opposed edges so that similar panels can be locked together at their adjacent side edges to form a continuous barrier wall. Because of the strength required of the panels when being driven into the earth and the strength required under load conditions, typically, the panels have been made of steel or aluminum. Frequently, steel and aluminum panels have over-sized cross sections to allow for the effects of corrosion. The additional material used in over-sizing increases the costs of the piles due to the material itself as well as the costs associated with handling the heavier piles.

In recent years, structural panels have been constructed of polyvinyl chloride and other plastics having relatively low tensile strength and high compression strength. The panels are extruded in a continuous manufacturing process, and in order to provide the strengths in the panel necessary to withstand the loads that are expected to be applied to the panels, the thicknesses of the panels have been increased over the typical thickness of similar panels formed of steel or aluminum. Further increases in thickness of the plastic provides a diminishing return. The increased bending strength does not offset the cost of the additional plastic.

In order to produce a structural panel formed of a synthetic material that is to be used as a driven pile in the formation of a barrier wall, the panels have been formed in various strengthening cross-sectional shapes, such as V-shapes, Z-shapes, U-shapes, etc., that provide resistance to bending in response to the application of axial and/or lateral loads to the panels. Further, the panels have been constructed so as to have at their opposite edges male and female locking elements, so that the edge of one panel locks with and supports the edge of an adjacent panel.

After the first panels have been driven into place, subsequent panels can be driven into place adjacent the previously driven panels with their male and female edges locked together as they are driven, thereby forming a continuous barrier wall. The barrier wall typically is held in place with a series of horizontally placed structural members, or wales, that extend along the exposed outer surface of the barrier wall. The wales frequently are held in place with a plurality of tie rods. The tie rods extend through the wale, the barrier wall, and the soil disposed behind the barrier wall, and have one end secured to the wale and another end which is secured to a force abutter. Typically, the force abutter is a reinforced cement wall disposed a desired distance behind the barrier wall such that adequate force is exerted from the force abutter through the tie rods on the barrier wall, thereby maintaining the barrier wall in the desired position. As constructed, these barrier walls have a number of obstructions, such as wales, tie rods, etc., present on the exposed outer surface of the barrier wall. These obstructions are subject to damage from, and may cause damage to, boats, barges, and like craft that frequently operate near and are secured to such barrier walls.

Therefore, there is a need for improved extruded structural members which address these and other shortcomings of the prior art.

SUMMARY OF THE INVENTION

Briefly described, the present invention relates to a structural panel for forming sea walls, barrier walls, and the like, fabricated of synthetic resin material for driving into soils. The structural panel is elongated and of constant size and shape along its length, and is characterized by having been extruded lengthwise. The structural panel includes, in cross section, a central wall section having an inner surface, an outer surface, a first side wall section, and a second side wall section. A male locking element is disposed on and extends laterally from the first side wall section while a female locking element is disposed on and extends laterally from the second side wall section, the female locking element being configured to slidably receive and retain the male locking element of a duplicate panel. First and a second strengthening flanges are integrally formed on the inner surface, the first and second strengthening flanges being both substantially perpendicular to the central wall section and substantially parallel to each other. The first and second strengthening flanges extend along the length of the structural panel.

The present invention also relates to a driven wall structure for retaining soil, the wall including a plurality of structural panels. Each of the panels includes, in cross section, a central wall section having an inner surface, an outer surface, a first side wall section, and a second side wall section. A male locking element is disposed on and extends laterally from the first side wall section while a female locking element is disposed on and extends laterally from the second side wall section. The female locking element is configured to slidably receive and retain the male locking element. At least one strengthening flange is integrally formed on the inner surface, the strengthening flange being substantially perpendicular to the central wall section and extending along the length of the structural panel. The plurality of structural panels is slidably connected by the male locking elements and the female locking elements of adjacent structural panels. A plurality of anchor bars extend through the strengthening flanges such that the anchor bars are substantially parallel to both the wall structure and other of the anchor bars. A plurality of anchor sheets is securely attached to the anchor bars, each anchor sheet extending outwardly from the wall structure. Soil is disposed about the anchor sheets such that the weight of the soil retains the wall structure in a desired position.

The present invention also provides a method of installing a driven wall structure for retaining soils, the wall including a means for retaining the wall in a fixed position relative to the soils, a series of elongated structural panels each having an upper end portion and a lower end portion, opposed inner and outer surfaces, elongated opposed edges shaped for slidably connecting to the edge of an adjacent structural panel, and at least one strengthening flange extending from the inner surface. The method includes the steps of: joining one of the opposed edges of each structural panel to one of the opposed edges of a previously driven structural panel and driving the lower end portion of each structural panel into the soil, thereby forming the wall structure; attaching the means for retaining to the strengthening flanges of the structural panels; and disposing soil both about the means for retaining and adjacent the inner surfaces of the structural panels.

Other objects, features and advantages of the present invention will become apparent upon reading the following specification, when taken in conjunction with the accompanying drawings.

BRIEF DESCRIPTION OF THE SEVERAL VIEWS OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION OF THE PREFERRED EMBODIMENT

Figure 1:
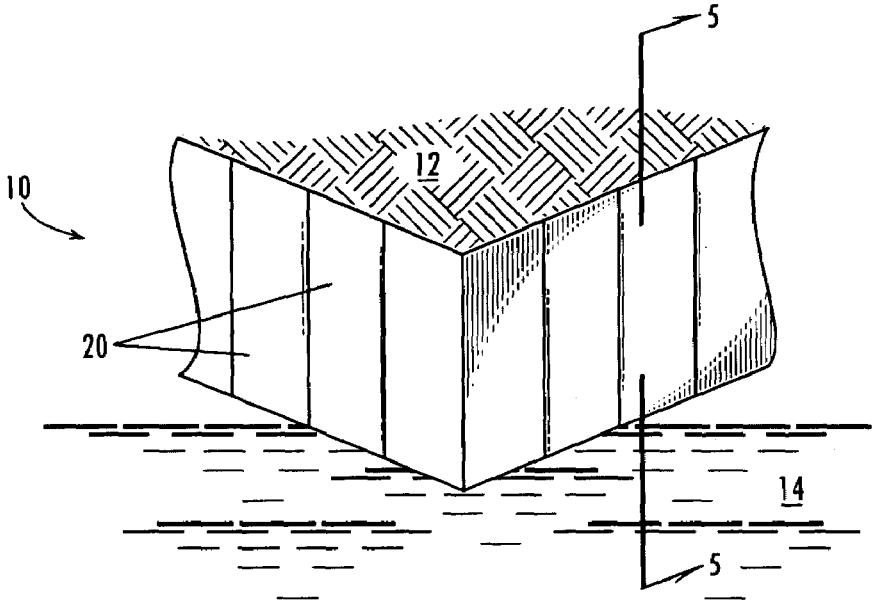
FIG. 1 is a perspective fragmentary view of a barrier wall constructed in accordance with an embodiment of the present invention, used as a sea wall.

Reference will now be made in detail to the description of the invention as illustrated in the drawings. While the invention will be described in connection with these drawings, there is no intent to limit it to the embodiment or embodiments disclosed therein. On the contrary, the intent is to cover all alternatives, modifications and equivalents included within the spirit and scope of the invention as defined by the appended claims.

Figure 5A:
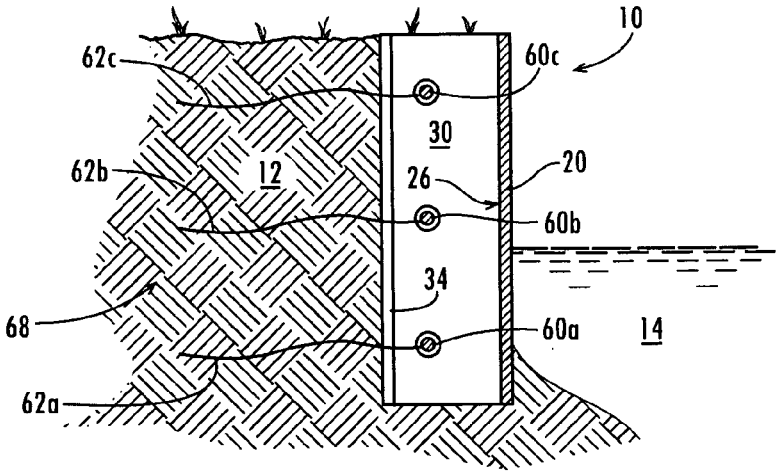
FIGS. 5A and 5B illustrate partially cut-away, side elevations of the barrier wall of the present invention, as shown in FIG. 1, taken along line V—V, illustrating various embodiments of anchor systems.
Figure 5B:
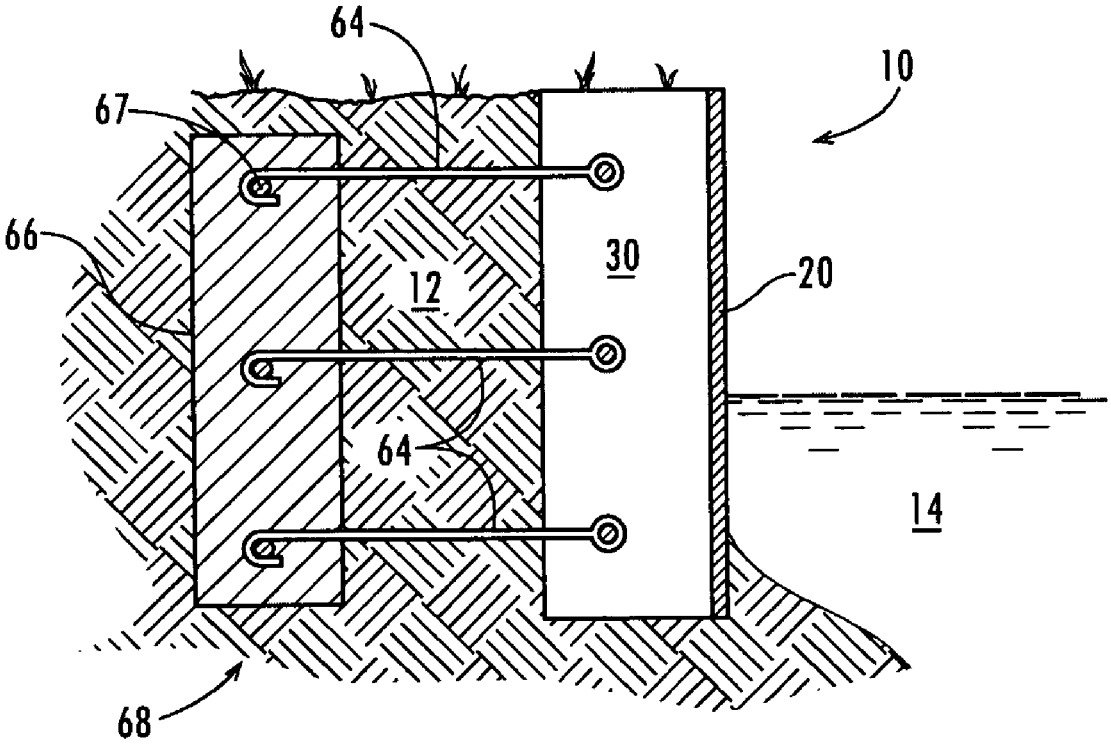

In particular, FIG. 1 illustrates a barrier wall, in the form of a sea wall 10, constructed of structural panels 20 according to the present invention. Typically, the sea wall 10 forms a retainer for the soil 12 on the backside of the structural panels 20, with water 14 at the front surface. The panels 20, as shown in FIGS. 5A and 5B, extend vertically with lower ends received in the subsoil below the lower level of the body of water 14. The panels 20 are joined in side edge to side edge relation and maintained in the desired position by an anchor system 68.

Figure 2:
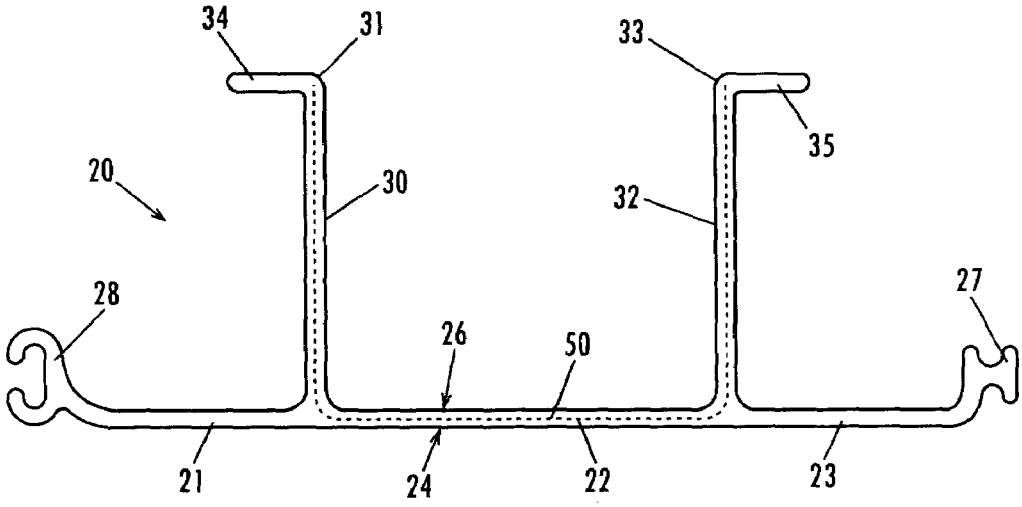
FIG. 2 illustrates a cross-sectional view of a preferred embodiment of a structural panel of the present invention.

FIG. 2 illustrates one of the structural panels 20. Each structural panel is formed of a plastic, such as polyvinyl chloride, polypropylene, polyethylene or other suitable synthetic or polymer material. Preferably, the materials chosen are strong and highly resistant to adverse weather conditions, and include properties that adequately resist abrasion from soils, resist deterioration due to ultra-violet radiation, and can withstand the bending and compressive forces normally encountered under conditions such as being driven into the ground.

The structural panels 20 are extruded lengthwise so as to form a constant, uniform cross-section from end-to-end. In a preferred embodiment, each panel 20 includes in cross-section a central wall section 22, side wall sections 21 and 23 on opposite sides of and coextensive with central wall section 22, and a pair of first and second strengthening flanges 30, 32 extending from the inner surface 26 of the structural panel 20. The strengthening flanges 30, 32 are substantially perpendicular to the central wall section 22 and extend lengthwise along the structural panel 20. Preferably, each strengthening flange 30, 32 includes at its distal edge 31, 33, oppositely facing secondary flanges 34, 35, respectively, such that the secondary flanges 34, 35 are substantially perpendicular to their respective strengthening flange 30, 32.

A male locking element 27 and a female locking element 28 are disposed at opposite edges of the side wall sections 21 and 23. Other configurations are possible for the male and female locking elements 27 and 28. However, typically, the female locking element 28 comprises a channel configured to slidably receive the male locking element 27 that consists of a protrusion. Preferably, the outer surface 24*a*, 24*b* and 24*c* of the central wall section 22 and side wall sections 21 and 23 are substantially co-planar such that when the structural panels are assembled in inner locking side edge to side edge relationship to form a barrier wall 10 the barrier wall will have a similarly substantially planar outer surface.

In the preferred embodiment shown in FIG. 2, an internal strengthening member 50, as indicated by the dashed line, may be comprised of steel, galvanized steel, aluminum or like materials, and has portions that extend from the first strengthening flange 30 through the central wall section 22 and into the second strengthening flange 32. Note however, embodiments are envisioned that include only one strengthening flange 30, 32 and a strengthening member 50 that extends at least partially into both the strengthening flange 30, 32 and the central wall section 22. The strengthening member 50 is encased in the material of the structural panel so that the strengthening member 50 is shielded from contact with the outside environment.

Figure 3:
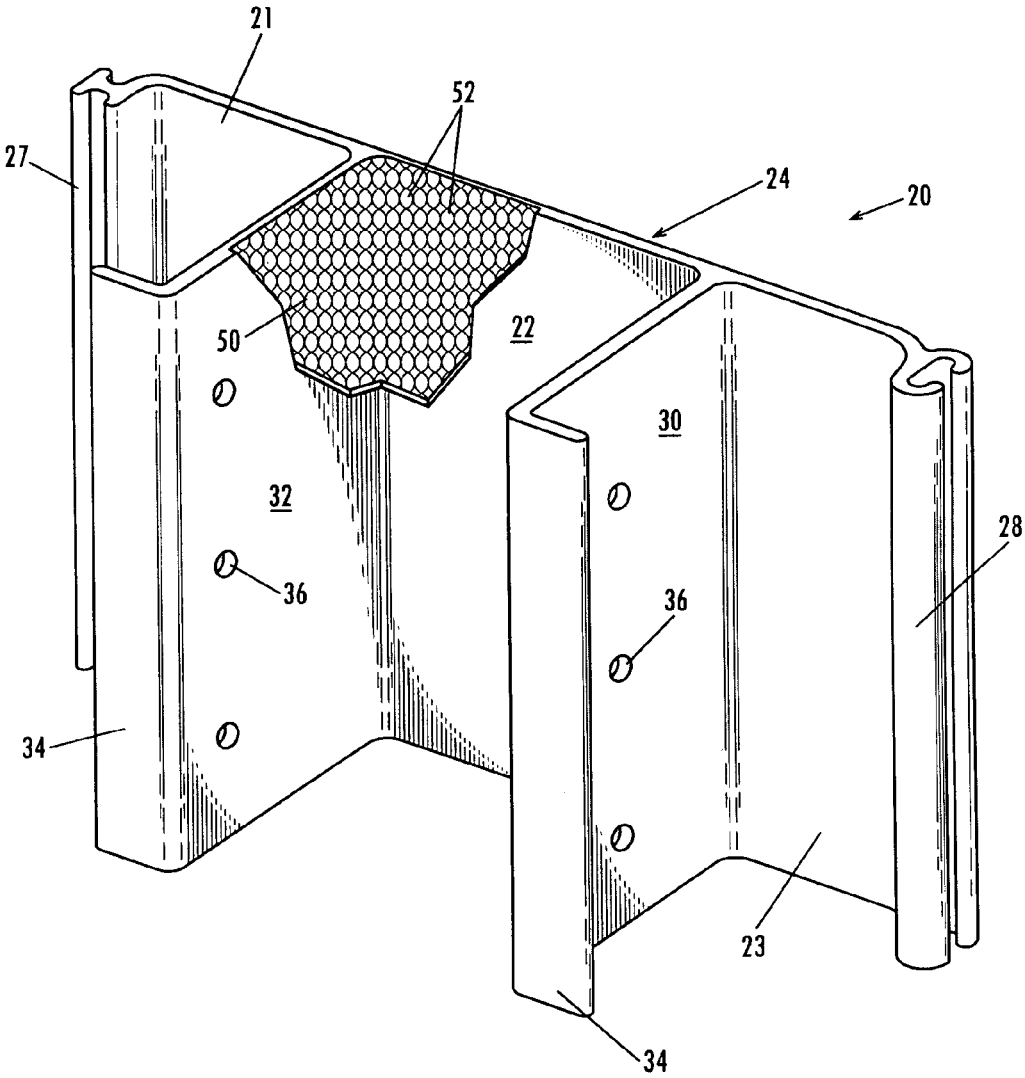
FIG. 3 is a perspective view of the structural panel with portions broken away to illustrate the strengthening member and the surrounding extruded coating.

FIG. 3 shows a perspective view of the structural panel 20 shown in FIG. 2, with portions of the extruded material removed to better show the strengthening member 50.

Preferably, the strengthening member 50 is constructed of an expanded metal, such as steel. The expanded metal is of known construction, that includes sheet metal formed with an array of parallel, longitudinally offset slits that have been opened by lateral expansion of the sheet to form perforations in the sheet. However, the strengthening member 50 may also be formed from a solid sheet of metal, a solid sheet of fiberglass, or a perforated sheet of fiberglass.

As shown in FIG. 3, each strengthening flanges 30 and 32 include a plurality of retention apertures 36 that are disposed along the length of each of the strengthening flanges 30, 32. Preferably, the retention apertures 36 in the first strengthening flange 30 are positioned such that they coincide with the retention apertures 36 formed in the second strengthening flange 32.

Figure 4:
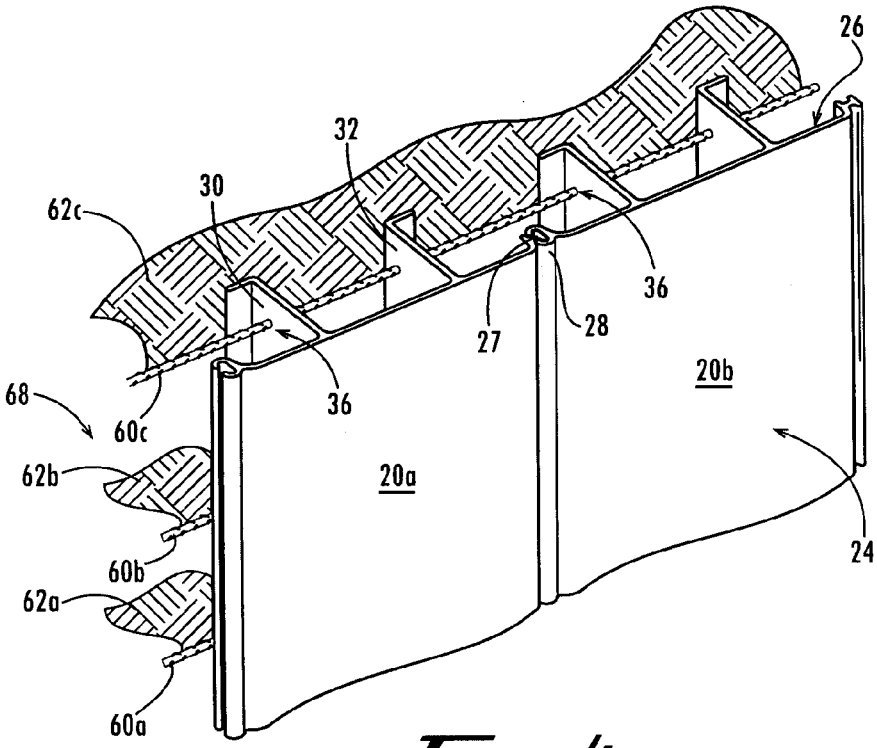
FIG. 4 is a perspective illustration of adjacent structural panels with their locking elements attached and an anchor system extending rearwardly therefrom.

FIG. 4 illustrates a pair of structural panels 20*a*, 20*b* positioned in side-by-side interlocking relationship, with the female locking element 28 of structural panel 20*b* telescopically engaged with the male locking element 27 of structural panel 20*a*. Typically, when a structural panel, such as 20*b*, is to be driven into the earth at the construction site, the structural panel 20*b* is positioned higher and adjacent a previously installed structural panel 20*a* with the female locking element 28 positioned above the male locking element 27 of the previously installed adjacent structural panel 20*a*. The structural panel 20*b* being installed is then moved downwardly so that the female locking element 28 guides itself along the length of the male locking element 27 of the adjacent previously installed structural panel 20*a*, and the structural panel 20*b* is progressively moved downwardly by driving, vibration, gravity, or other external forces, until the upper ends of the structural panels 20*a*, 20*b* become located at approximately the desired height. If necessary, the upper ends of the structural panels 20*a*, 20*b* that cannot reach the desired height can be cut away. In the preferred embodiment, the first and second strengthening flanges 30, 32 assist in driving operations in that the required external force applied to the upper end of the structural panel is distributed over a larger surface area than just that of the central wall section 22 (FIG. 2). As well, the strengthening member 50 assists in transmitting those external forces vertically through the structural panels and into the soils 12 underneath.

After adjacent structural panels 20*a*, 20*b* have been driven to the desired height, an anchor system 68 can be installed. The anchor system 68 shown in FIG. 4 includes a plurality of anchor bars 60*a–c* and anchor sheets 62*a–c*. Individual anchor bars 60*a–c* and anchor sheets 62*a–c* have been given supplemental letter designations for ease of description only. Ideally, each structural panel 20*a*, 20*b* is driven to the desired height. As such, the retention apertures 36 disposed in the strengthening flanges 30 and 32 of both structural panels 20*a*, 20*b* will be axially aligned. So aligned, each anchor bar 60*a–c* can be passed through its respective set of retention apertures 36 located in the various structural panels 20*a*, 20*b*. This is most clearly seen in that anchor bar 60*c* passes through the retention apertures 36 disposed in the adjacent structural panels 20*a*, 20*b*. However, as previously noted, it may be necessary to remove a top portion of one of the structural panels 20*a*, 20*b*, in which case the retention apertures 36 of the adjacent structural panels 20*a*, 20*b* may not be axially aligned. In this case, it is possible for the installer to create auxiliary retention apertures 36 on the job site to allow passage of the anchor bars 60*a–c*. In the preferred embodiment shown, providing auxiliary retention apertures 36 is facilitated in that the strengthening member 50 is constructed of expanded metal having a plurality of perforations 52 (FIG. 3). Ideally, the perforations 52 of the expanded metal anchor sheet allow auxiliary retention apertures 36 to be drilled therethrough, without having to drill through the metal of the strengthening member. However, even when the strengthening member 50 is comprised of sheet metal, auxiliary retention apertures 36 may be constructed. Also, the retention apertures 36 usually are of greater breadth than the anchor bars 60 so that perfect alignment of the retention apertures 36 may not be necessary. Also, since each panel has retention apertures 36 in both of its strengthening flanges 30, 32, short anchor bars 60 can be used to hold the anchor sheet 62 without the anchor bars extending to adjacent panels.

Anchor sheets 62*a–c* are securely connected to the plurality of anchor bars 60*a–c*. Note, each anchor sheet 62*a–c* may be secured to its respective anchor bar 60*a–c* either prior to, during, or after installation of the anchor bars 60*a–c* into the structural panels 20*a*, 20*b*. Generally, the anchor sheets 62*a–c* are substantially flat sheets which define a plurality of large openings or apertures. During construction of the barrier wall 10 (FIG. SA) back fill soil 12 covers the anchor sheet 62*a–c*. Rocks, stones and soil in the back fill occupy apertures in the sheets. These materials mechanically connect the anchor sheets 62*a–c* to the soil mass 12, and thereby secure the barrier wall 10 to the soil mass 12. Thus, the retention apertures 36 and anchor bars 60 function as connection means for connecting the anchor sheets 62 to the structural panel. Other connection means can be used, such as clamps that extend from the anchor bars to the secondary flanges 34, 35.

Referring now to FIG. 5A, after the structural panel 20 has been driven to the desired depth, anchor bar 60*a* and anchor sheet 62*a* are installed. Anchor sheet 62*a* is extended rearwardly and allowed to rest on top of the existing soil. Soil is then placed on top of anchor sheet 62*a* up to approximately the level at which the next anchor bar 60*b* and anchor sheet 62*b* will be installed. After installation of anchor bar 60*b* and anchor sheet 62*b*, anchor sheet 62*b* is allowed to rest on the existing soil. Soil is once again disposed on top of anchor sheet 62*b*, thereby maintaining anchor sheet 62*b* in position. This process is repeated until the desired number of anchor bars 60 and anchor sheets 62 have been installed. The plurality of anchor sheets 62 exert a retention force on the barrier wall 10. Embodiments of barrier walls 10 are envisioned having as few as one anchor bar 60 and one anchor sheet 62. However, typical barrier walls 10 include pluralities of each.

Referring now to FIG. 5B, another embodiment of an anchor system 68 is shown. An anchor wall 66 of poured reinforced concrete is placed behind the barrier wall 10 and extends generally parallel to the wall 10. Anchor members 64, typically tie rods, are connected at one end to a reinforcing rod 67 embedded in the anchor wall 66 and at the opposing end to the strengthening flange 30 of the structural panel 20, thereby holding the barrier wall 10 in the desired position. A plurality of anchor members 64 extend from the anchor wall 66 to the barrier wall 10 at intervals along the length of the wall 10. Following installation, the space between the barrier wall 10 and anchor wall 66 is filled with soil 12.

Although preferred embodiments of the invention have been disclosed in detail herein, it will be obvious to those skilled in the art that variations and modifications of the disclosed embodiment can be made without departing from the spirit and scope of the invention as set forth in the following claims.

Therefore, having thus described the invention, at least the following is claimed:

1. A structural panel fabricated of synthetic resin material for driving into soils and forming walls, piers, and dikes, comprising:

said structural panel being elongated and of constant size and shape along its length and shaped for being continuously manufactured in one piece;

said structural panel including in cross section:

a central wall section including an inner surface, an outer surface, and opposed side wall sections coplanar with said central wall section and forming with said central wall section a substantially flat outer surface of the structural panel;

a male locking element disposed on and extending laterally from one of said side wall sections, a female locking element disposed on and extending laterally from the other of said side wall sections, said female locking element being configured to slidably receive and retain said male locking element of a duplicate structural panel, said male and female locking elements configured not to protrude beyond the substantially flat outer surface of the structural panel; and first and second strengthening flanges integrally formed on said inner surface, said first and second strengthening flanges being both substantially perpendicular to said central wall section and to said side sections and substantially parallel to each other, said first and second strengthening flanges extending along said length of said structural panel and with said central wall section forming a U-shape with the opening of the U-shape facing away from said central wall section such that access is available between the strengthening flanges along the length of the structural panel.

2. The structural panel of claim 1, further including a strengthening sheet having been encased in said material by extrusion of said structural panel and shielded by said material from contact with the outside environment.

3. The structural panel of claim 2, wherein said strengthening sheet comprises metal sheet material, said strengthening sheet being U-shaped in cross section, and wherein said strengthening member is disposed in said U-shape of said structural panel formed by said first and second strengthening flanges and said central wall section.

4. The structural panel of claim 2, wherein said strengthening sheet is comprised of material selected from the group consisting essentially of: steel, galvanized steel, expanded metal, fiberglass and aluminum.

5. The structural panel of claim 2, wherein said strengthening sheet is comprised of expanded metal, said expanded metal defining a plurality of perforations.

6. The structural panel of claim 5, wherein said expanded metal is comprised of material selected from the group consisting of: steel and galvanized steel.

7. The structural panel of claim 2, wherein said strengthening member comprises fiberglass, said strengthening member being U-shaped in cross section, and wherein said strengthening member is disposed in a similarly U-shaped portion of said structural panel formed by said first and second strengthening flanges and said central wall section.

8. The structural panel of claim 7, wherein said strengthening member is perforated.

9. A structural panel fabricated of synthetic resin material for driving into soils and forming walls, piers, and dikes, comprising:

said structural panel being elongated and of constant size and shape along its length and shaped for being continuously manufactured;

said structural panel including in cross section:

a central wall section including an inner surface, an outer surface, and opposed side wall sections coplanar with said central wall section;

a locking elements disposed on and extending laterally from the side wall sections for connecting duplicate structural panels together in side-edge to side-edge relationship, first and second strengthening flanges integrally formed on said inner surface, said first and second strengthening flanges being both substantially perpendicular to said central wall section and substantially parallel to each other, said first and second strengthening flanges extending along said length of said structural panel and with said central wall section forming a U-shape with the opening of the U-shape facing away from said central wall section such that access is available between the strengthening flanges along the length of the structural panel, said strengthening flanges each including a distal edge and a secondary flange extending from said distal edge of each of said strengthening flanges and extending away from the other strengthening flange such that said secondary flanges are substantially perpendicular to said strengthening flanges.

10. A structural panel fabricated of synthetic resin material for driving into soils and forming walls, piers, and dikes, comprising:

said structural panel being elongated and of constant size and shape along its length and shaped for being continuously manufactured in one piece;

said structural panel including in cross section:

a central wall section including an inner surface, an outer surface, and opposed side wall sections coplanar with said central wall section;

locking elements disposed on and extending laterally from said side wall sections for connecting duplicate ones of the structural panels together, said locking elements configured such that the locking elements do not extend beyond the plane of the central wall section and the opposed side wall sections of the connected structural panels, first and second strengthening flanges integrally formed on said inner surface, said first and second strengthening flanges being both substantially perpendicular to said central wall section and substantially parallel to each other, said first and second strengthening flanges extending along said length of said structural panel and with said central wall section forming a U-shape with the opening of the U-shape facing away from said central wall section such that access is available between the strengthening flanges along the length of the structural panel, a first plurality of retention apertures disposed along the length of said first strengthening flange;

a second plurality of retention apertures disposed along the length of said second strengthening flange; and wherein said retention apertures are configured to receive retention means between said first and second strengthening flanges, said retention means being configured to retain said structural panel in a fixed position in relation to the soils into which said structural panel is driven.

11. A barrier wall comprising a series of structural panels of the type described in claim 10, wherein said retention means further comprise:

an anchor bar configured to pass through one of said retention apertures of each said first and second pluralities of retention apertures such that said anchor bar is disposed substantially parallel to said central wall section and substantially perpendicular to said first and second strengthening flanges;

an anchor sheet configured to extend between said first and second strengthening flanges and be securely attached to said anchor bar; and wherein said anchor sheet is connected to said structural panel by said anchor bar such that said anchor sheet extends outwardly into the soils disposed behind said structural panel, thereby securing said structural panel adjacent the soils.

12. A structural panel for driving into soils and forming walls, piers, and dikes, comprising:

said structural panel being elongated and of constant size and shape along its length and fabricated of synthetic resin material and shaped for being continuously manufactured;

said structural panel including in cross section:

a central wall section including an inner surface, an outer surface, and opposed side wall sections coplanar with said central wall section and forming with said inner wall a substantially flat outer surface of the structural panel;

locking elements disposed on and extending laterally from said side wall sections configured for locking duplicate ones of the structural panels together, first and second strengthening flanges integrally formed on said inner surface, said first and second strengthening flanges being both substantially perpendicular to said central wall section and to said side sections and substantially parallel to each other, said first and second strengthening flanges extending along said length of said structural panel and with said central wall section forming a U-shape with the opening of the U-shape facing away from said central wall section such that access is available between the strengthening flanges along the length of the structural panel, a first plurality of retention apertures disposed along the length of said first strengthening flange;

a second plurality of retention apertures disposed along the length of said second strengthening flange; and retention means received in said retention apertures configured to extend from between said first and second strengthening flanges and retain said structural panel in a fixed position in relation to the soils into which the structural panel is driven.

13. The structural panel of claim 12, wherein said retention means further comprise:

an anchor bar configured to pass through one of said retention apertures of each said first and second pluralities of apertures such that said anchor bar is disposed substantially parallel to said central wall section and substantially perpendicular to said first and second strengthening flanges;

an anchor sheet configured to be securely attached to said anchor bar; and wherein said anchor sheet is connected to said structural panel by said anchor bar such that said anchor sheet extends outwardly into the soils disposed behind said structural panel, thereby securing said structural panel adjacent the soils.

14. The structural panel of claim 12, wherein each of said retention apertures of said first and second pluralities of retention apertures extends through one of said perforations of said expanded metal such that said strengthening member is encapsulated within said structural panel.

15. A method of installing a driven wall structure for retaining soils, the wall including a means for retaining the wall in a fixed position relative to the soils, a series of elongated structural panels, each said structural panel being elongated and of constant size and shape along its length, and shaped for being manufactured in one piece, each having an upper end portion and a lower end portion, opposed inner and outer surfaces, said outer surface being substantially flat, elongated opposed side edges having locking elements shaped for slidably connecting to the side edges of an adjacent structural panels with the outer surfaces of the adjacent panels arranged in the same plane and the locking elements not extending beyond the plane of the outer surfaces, and a pair of spaced, parallel strengthening flanges extending from the inner surface, comprising the steps of:

joining the locking element of the opposed side edges with the locking element of each structural panel to one of the opposed side edges of a previously driven structural panel and driving the lower end portion of each structural panel into the soil, thereby forming the wall structure with a flat an outside surface;

attaching the means for retaining to the strengthening flanges of the structural panels; and disposing soil about the means for retaining and between the strengthening flanges and adjacent the inner surfaces of the structural panels.

16. The method of claim 15, wherein the step of attaching the means for retaining to the strengthening flanges further comprises:

passing an anchor bar through the strengthening flanges such that the anchor bar is substantially parallel to the wall structure;

securing an anchor sheet to the anchor bar, thereby securing the anchor sheet to the wall structure; and extending the anchor sheet outwardly from the inner surface of the wall structure such that the anchor sheet is substantially perpendicular to the wall structure and rests on the existing soil.

17. The method of claim 15, wherein the step of attaching the means for retaining to the strengthening flanges further comprises:

securing a plurality of anchor members to the strengthening flanges, each anchor member having a proximal end secured to one of the strengthening flanges and a distal end extending outwardly from the wall structure;

securing the distal end of each anchor member to an anchor wall, the anchor wall being substantially parallel to the wall structure.

18. A driven wall structure for retaining soil, comprising:

a plurality of structural panels, each said panel being elongated and of constant size and shape along its length and shaped for being continuously manufactured, including in cross section:

a central wall section including an inner surface and an outer surface, opposed first and second side wall sections on opposite sides of said central wall section co-extensive with said central wall section and forming the structural panel with a planar outer surface;

a first locking element disposed on and extending laterally from said first side wall section, a second locking element disposed on and extending laterally from said second side wall section, said first and second locking elements being configured to slidably receive and retain locking elements of similar structural panels and lock the structural panels together in edge-to-edge relationship; and said first and second locking elements being formed such that the locking elements do not protrude beyond the plane of the outer surface of said structural panel, such that when a plurality of the structural panels are assembled in parallel inner locking side-edge to side-edge relationship to form the driven wall structure, the driven wall structure has a substantially planar outer surface without the locking elements protruding beyond the planar outer surface;

at least one strengthening flange integrally formed on said inner surface of said central wall section, said strengthening flange being substantially perpendicular to said central wall section and extending along said length of said structural panel;

a plurality of anchor sheets, each said anchor sheet being securely attached to said strengthening flange of a panel one of said anchor bars and extending outwardly from said wall structure; and wherein the soil is disposed about said strengthening flange and about said anchor sheets such that the weight of the soil retains the wall structure in a desired position.

19. The wall structure of claim 18, wherein said structural panel further comprises a strengthening member comprised of expanded steel, said strengthening member being substantially L-shaped in cross-section, and wherein said strengthening member is disposed in a similarly L-shaped portion of said structural panel formed by said strengthening flange and a portion of said central wall section.

20. The wall structure of claim 19, wherein said structural panel is comprised of a material selected from the group consisting of: polyvinyl chloride, polypropylene and polyethylene.

21. The wall structure of claim 19, wherein said strengthening member has a thickness of approximately 0.010 inches to 0.750 inches.

22. The wall structure of claim 18, wherein said structural panel further comprises:

said strengthening flange includes a first strengthening flange and a second strengthening flange forming a U-shape with said panel; and a strengthening member comprised of metal, said strengthening member being U-shaped in cross section, and wherein said strengthening member is disposed in a similarly U-shaped portion of said structural panel formed by said first and second strengthening flanges and a portion of said central wall disposed therebetween.

23. The wall structure of claim 22, wherein said strengthening member is further comprised of expanded metal, said expanded metal defining a plurality of perforations, and wherein each of said anchor bars extends through said perforations such that said strengthening member is encapsulated within said structural panel.

24. The wall structure of claim 23, wherein said strengthening member is comprised of a material selected from the group consisting of: steel and galvanized steel.

25. The wall structure of claim 18, wherein said structural panel further comprises:

a first and a second strengthening flange; and a strengthening member comprised of fiberglass, said strengthening member being U-shaped in cross section, and wherein said strengthening member is disposed in a similarly U-shaped portion of said structural panel formed by said first and second strengthening flanges and a portion of said central wall disposed therebetween.

26. A structural panel for driving into soils and forming with duplicate structural panels a driven wall, said structural panel comprising:

a panel that is elongated and of constant size and shape along its length and shaped for being continuously manufactured in one piece, said panel including in cross section:

an inner surface and a flat outer surface opposed to said inner surface, and opposed side edges;

elongated locking elements formed on said opposed side edges configured to slidably receive and retain a locking element of a duplicate structural panel and join the duplicate structural panels in side-by-side relationship with the outer surfaces of the joined panels aligned and forming a flat wall surface;

said locking elements being formed such that the locking elements do not protrude beyond the flat outer surface of the panel, such that when a plurality of the structural panels are assembled in inner-locking side-edge to side-edge relationship with their outer surfaces aligned to form a straight wall with an outer surface, the locking elements do not protrude beyond the outer surface of the straight wall, and said structural panel having been formed about a strengthening member that is positioned in said structural panel and said strengthening member is protected by said structural panel from contact with other objects.

27. The structural panel of claim 26, and further including:

strengthening flanges integrally formed on said inner surface of said panel extending along the length of said panel at intervals spaced from each other and spaced from said elongated locking elements and extending away from said inner surface, said strengthening flanges together with a portion of said panel forming a U-shape with the opening of the U-shape facing away from said inner surface such that access is available between the strengthening flanges along the length of the structural panel, and said strengthening panels defining retention apertures for connecting said strengthening panels to an anchor wall.

28. The structural panel of claim 27 and further including: secondary strengthening flanges formed on said strengthening flanges, said secondary strengthening flanges extending away from each other.

29. The structural panel of claim 26, wherein said strengthening member is formed of sheet material and is positioned in said U-shape.

* * * * *